US006865889B2

(12) United States Patent
Mancini et al.

(10) Patent No.: US 6,865,889 B2
(45) Date of Patent: Mar. 15, 2005

(54) METHOD AND APPARATUS TO DECREASE COMBUSTOR EMISSIONS

(75) Inventors: Alfred A. Mancini, Cincinnati, OH (US); Michael L. Vermeersch, Hamilton, OH (US); Duane D. Thomsen, Loveland, OH (US); Allen M. Danis, Mason, OH (US); James N. Cooper, Hamilton, OH (US); Steven J. Lohmueller, Reading, OH (US); Hukam C. Mongia, Westchester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/061,148

(22) Filed: Feb. 1, 2002

(65) Prior Publication Data

US 2004/0079085 A1 Apr. 29, 2004

(51) Int. Cl.[7] ..... F02C 7/00
(52) U.S. Cl. ..... 60/737; 60/746; 60/748
(58) Field of Search ..... 60/776, 740, 746, 60/747, 804, 737, 748

(56) References Cited

U.S. PATENT DOCUMENTS 4,567,857 A 2/1986 Houseman et al.
5,323,604 A * 6/1994 Ekstedt et al. ..... 60/804
5,584,178 A 12/1996 Naegeli et al.
5,590,529 A 1/1997 Joshi et al.
5,613,363 A 3/1997 Joshi et al.
5,970,715 A 10/1999 Narang
6,070,410 A 6/2000 Dean
6,141,967 A 11/2000 Angel et al.
6,192,688 B1 2/2001 Beebe
6,195,607 B1 2/2001 Rajamani et al.
6,389,815 B1 * 5/2002 Hura et al. ..... 60/746
6,550,251 B1 * 4/2003 Stickles et al. ..... 60/776

* cited by examiner

*Primary Examiner*—Ehud Gartenberg
(74) *Attorney, Agent, or Firm*—William Scott Andes; Armstrong Teasdale LLP

(57) ABSTRACT

A method for operating a gas turbine engine facilitates reducing an amount of emissions from a combustor. The combustor includes a mixer assembly including a pilot mixer, a main mixer, and a centerbody that extends therebetween. The pilot mixer includes a pilot fuel nozzle and a plurality of axial swirlers. The main mixer includes a main swirler and a plurality of fuel injection ports. The method comprises injecting fuel into the combustor through the pilot mixer, such that the fuel is discharged downstream from the pilot mixer axial swirlers, and directing flow exiting the pilot mixer with a lip extending from the centerbody into a pilot flame zone downstream from said pilot mixer.

14 Claims, 4 Drawing Sheets

METHOD AND APPARATUS TO DECREASE COMBUSTOR EMISSIONS

BACKGROUND OF THE INVENTION

This application relates generally to combustors and, more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. In general, engine emissions fall into two classes: those formed because of high flame temperatures (NOx), and those formed because of low flame temperatures which do not allow the fuel-air reaction to proceed to completion (HC & CO).

At least some known gas turbine combustors include between 10 and 30 mixers, which mix high velocity air with a fine fuel spray. These mixers usually consist of a single fuel injector located at a center of a swirler for swirling the incoming air to enhance flame stabilization and mixing. Both the fuel injector and mixer are located on a combustor dome.

In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture.

One state-of-the-art lean dome combustor is referred to as a dual annular combustor (DAC) because it includes two radially stacked mixers on each fuel nozzle which appear as two annular rings when viewed from the front of a combustor. The additional row of mixers allows tuning for operation at different conditions. At idle, the outer mixer is fueled, which is designed to operate efficiently at idle conditions. At high power operation, both mixers are fueled with the majority of fuel and air supplied to the inner annulus, which is designed to operate most efficiently and with few emissions at high power operation. While the mixers have been tuned for optimal operation with each dome, the boundary between the domes quenches the CO reaction over a large region, which makes the CO of these designs higher than similar rich dome single annular combustors (SACs). Such a combustor is a compromise between low power emissions and high power NOx.

Other known combustors operate as a lean dome combustor. Instead of separating the pilot and main stages in separate domes and creating a significant CO quench zone at the interface, the mixer incorporates concentric, but distinct pilot and main air streams within the device. However, the simultaneous control of low power CO/HC and smoke emission is difficult with such designs because increasing the fuel/air mixing often results in high CO/HC emissions. The swirling main air naturally tends to entrain the pilot flame and quench it. To prevent the fuel spray from getting entrained into the main air, the pilot establishes a narrow angle spray. This may result in a long jet flames characteristic of a low swirl number flow. Such pilot flames produce high smoke, carbon monoxide, and hydrocarbon emissions and have poor stability.

Furthermore, the combination of the narrow angle spray and the swirling air may permit fuel impinging on the mixer to migrate along around an aft rounded corner of the dome assembly to an aft surface of the dome assembly. Continued operation with such fuel impingement may cause deposit formation, or may permit the fuel to become entrained within the main mixer flow. Both of these adverse effects may facilitate a reduced average fuel residence within the flame zone, resulting in an even smaller and cooler flame zone, and reduced low power combustion efficiency.

BRIEF SUMMARY OF THE INVENTION

In one aspect, a method for operating a gas turbine engine to facilitate reducing an amount of emissions from a combustor is provided. The combustor includes a mixer assembly including a pilot mixer, a main mixer, and a centerbody that extends therebetween. The pilot mixer includes a pilot fuel nozzle and a plurality of axial swirlers. The main mixer includes a main swirler and a plurality of fuel injection ports. The method comprises injecting fuel into the combustor through the pilot mixer, such that the fuel is discharged downstream from the pilot mixer axial swirlers, and directing flow exiting the pilot mixer with a lip extending from the centerbody into a pilot flame zone downstream from said pilot mixer.

In another aspect of the invention, a combustor for a gas turbine is provided. The combustor includes a pilot mixer, a main mixer, and an annular centerbody. The pilot mixer includes an air splitter, a pilot fuel nozzle, and a plurality of axial air swirlers upstream from the pilot fuel nozzle. The air splitter is downstream from the pilot fuel nozzle, and the air swirlers are radially outward from and concentrically mounted with respect to the pilot fuel nozzle. The main mixer is radially outward from and concentrically aligned with respect to the pilot mixer, and includes a plurality of fuel injection ports and a swirler including at least one of a conical air swirler and a cyclone air swirler. The main mixer swirler is upstream from the main mixer fuel injection ports. The centerbody extends between the pilot mixer and main mixer, and includes a radially inner surface including a divergent portion, an aft portion, and a lip that extends outwardly therebetween.

In a further aspect, a mixer assembly for a gas turbine engine combustor is provided. The mixer assembly is configured to control emissions from the combustor and includes a pilot mixer, a main mixer, and an annular centerbody. The pilot mixer includes a pilot fuel nozzle, and a plurality of axial swirlers that are upstream and radially outward from the pilot fuel nozzle. The main mixer is radially outward from and concentric with respect to the pilot mixer, and includes a plurality of fuel injection ports and a swirler that is upstream from the fuel injection ports. The centerbody extends between the main mixer and the pilot mixer and is configured to direct flow exiting the pilot mixer into a pilot flame zone downstream from the pilot mixer.

DETAILED DESCRIPTION OF THE INVENTION

Figure 1:
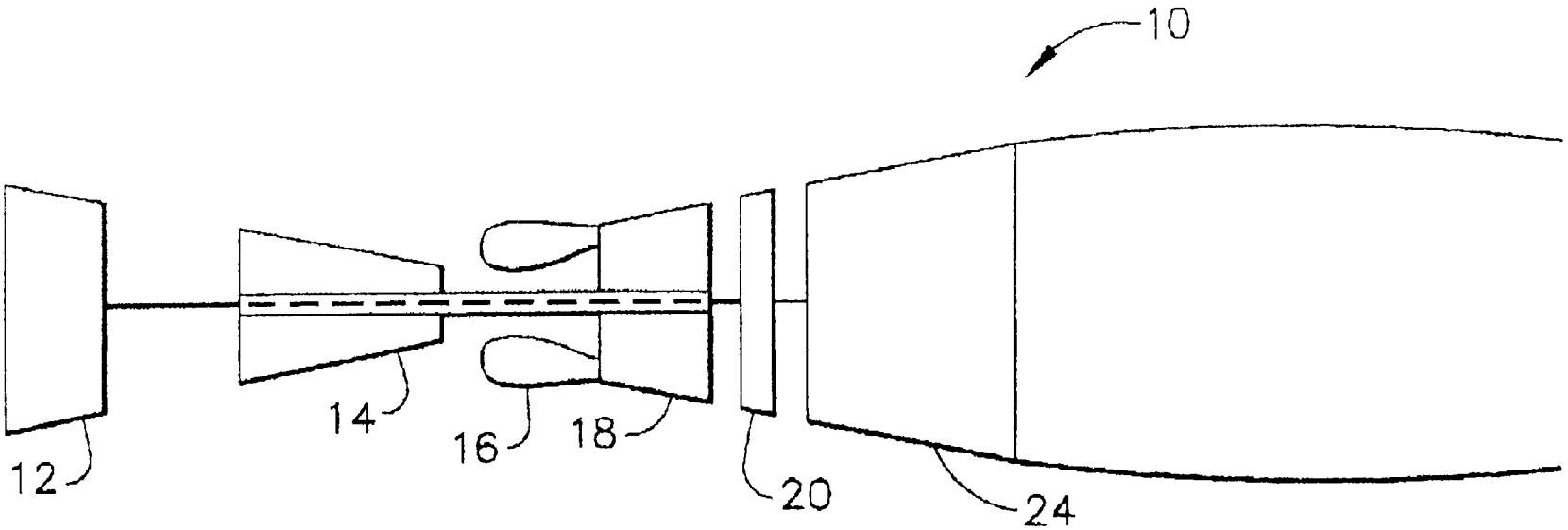
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
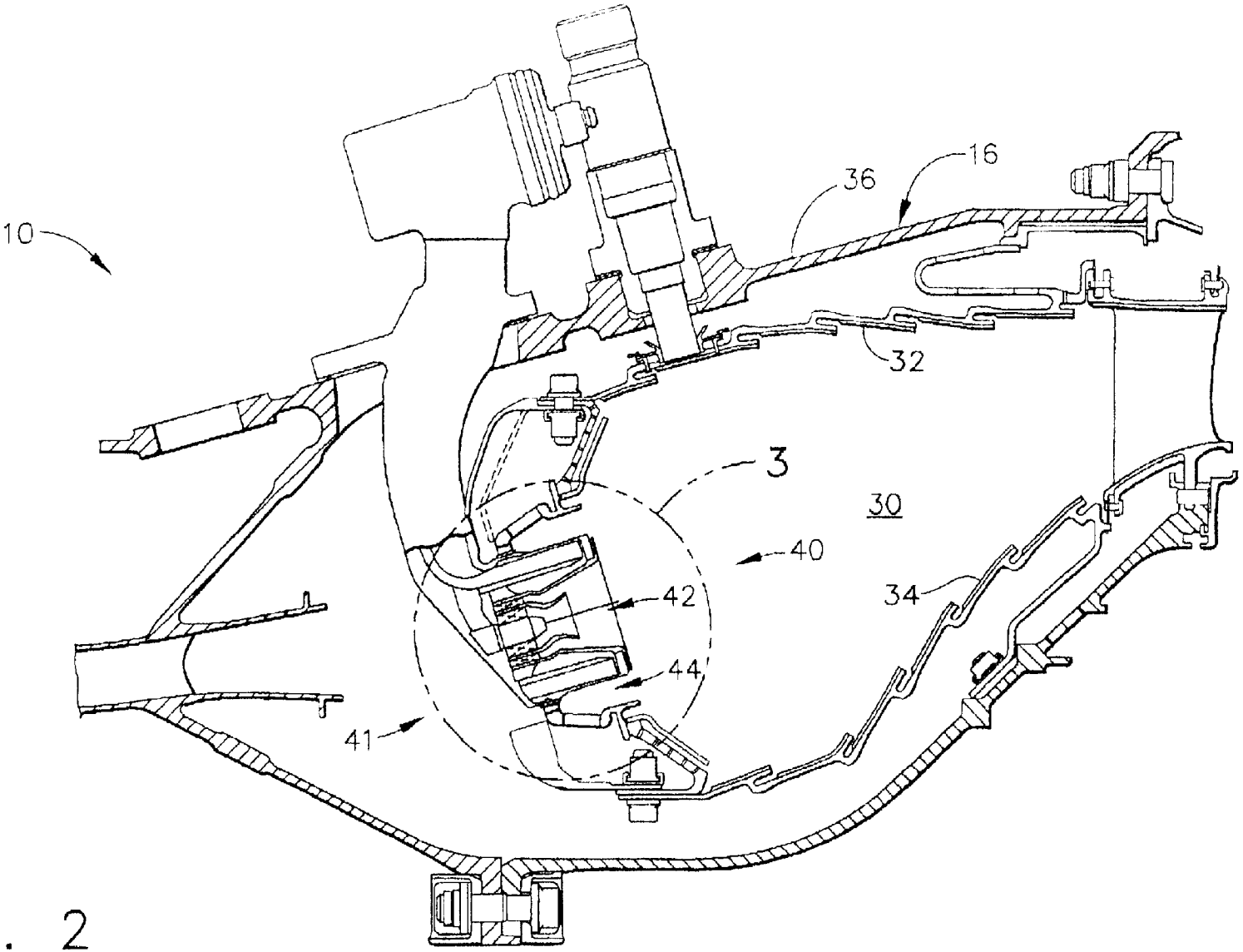
FIG. 2 is a cross-sectional view of a combustor that may be used with the gas turbine engine shown in FIG. 1.
Figure 3:
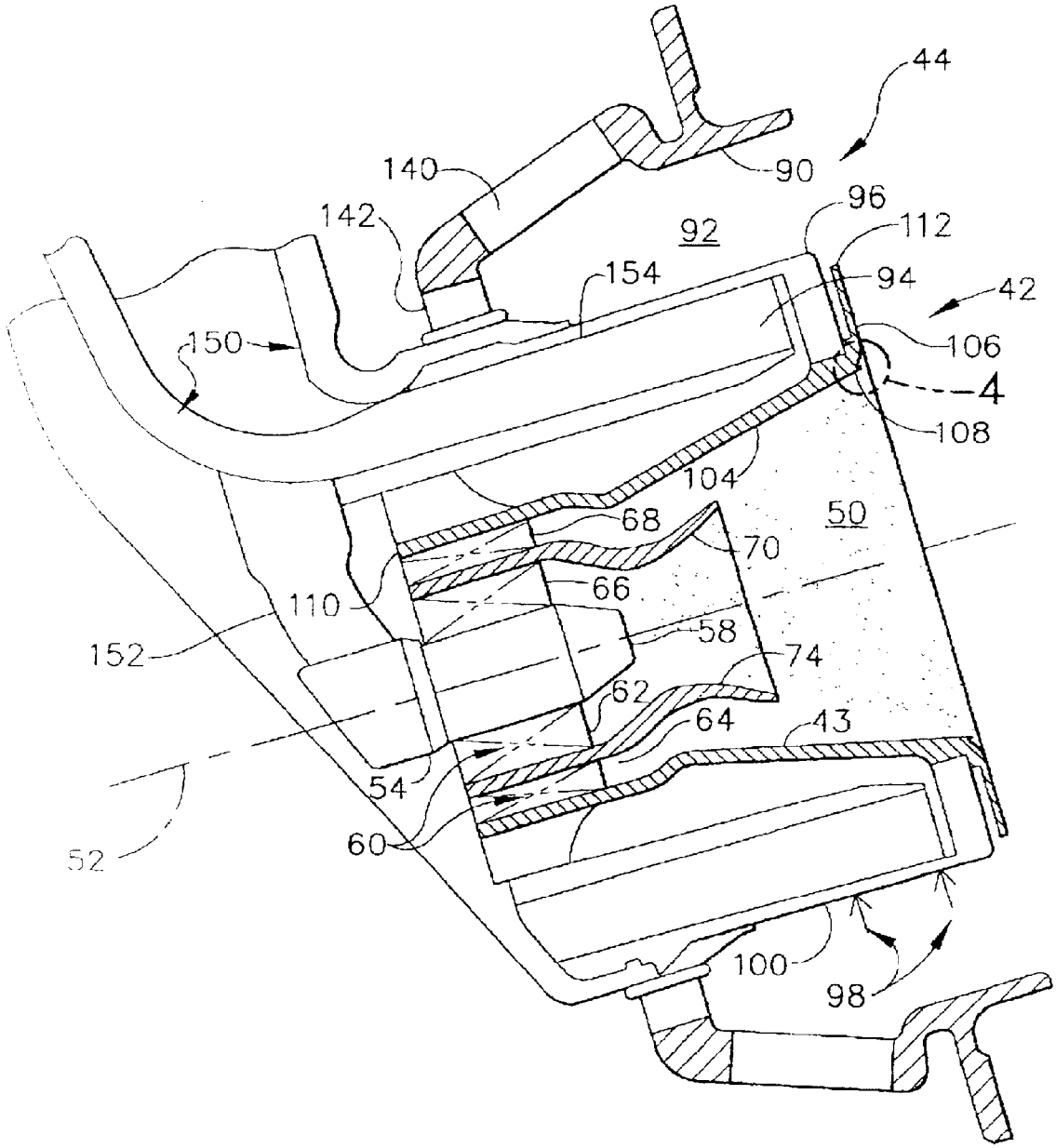
FIG. 3 is an enlarged view of a portion of the combustor shown in FIG. 2 taken along area 3.
Figure 4:
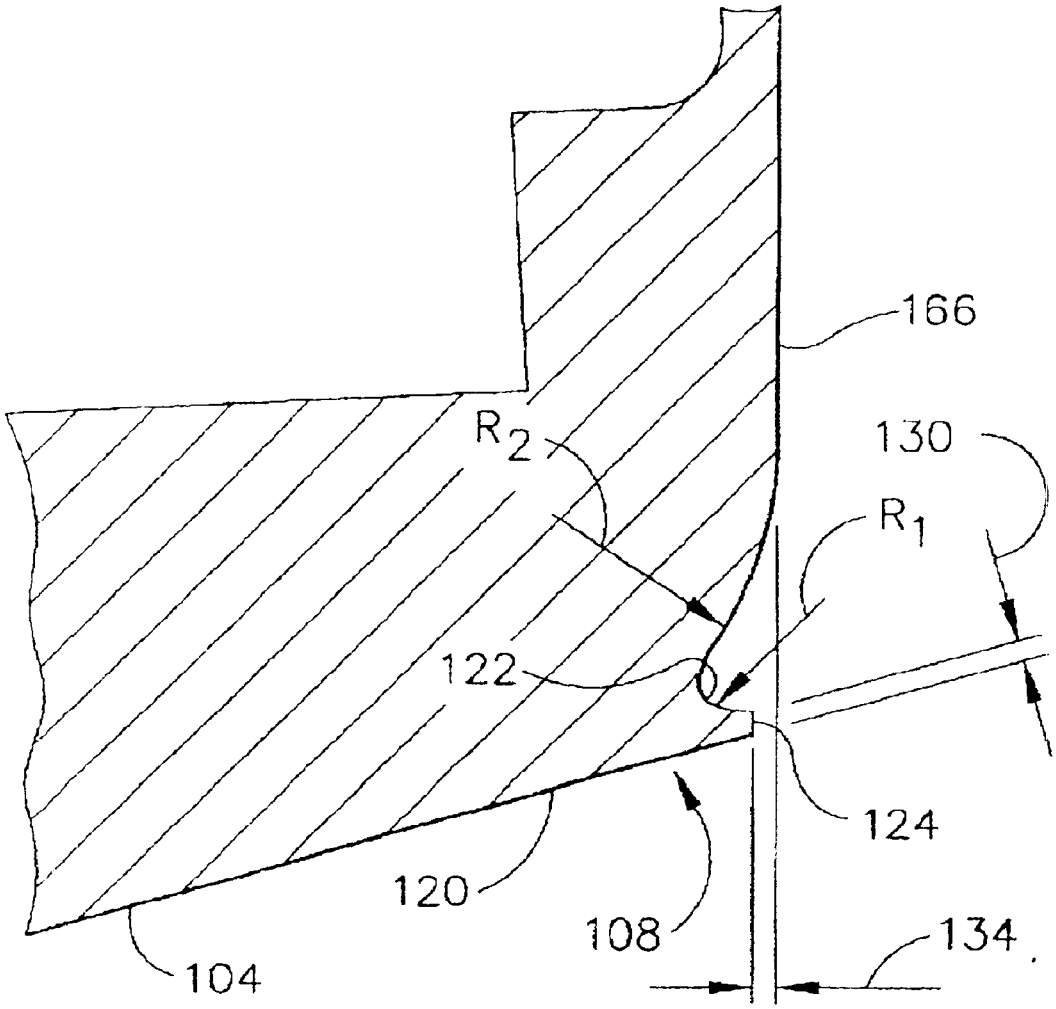
FIG. 4 is an enlarged view of the combustor shown in FIG. 3 taken along area 4.

FIG. 2 is a cross-sectional view of combustor 16 for use with a gas turbine engine, similar to engine 10 shown in FIG. 1, and FIG. 3 is an enlarged view of combustor 16 taken along area 3. FIG. 4 is an enlarged view of the combustor shown in FIG. 3 taken along area 4. In one embodiment, the gas turbine engine is a CFM engine available from CFM International. In another embodiment, the gas turbine engine is a GE90 engine available from General Electric Company, Cincinnati, Ohio.

Each combustor 16 includes a combustion zone or chamber 30 defined by annular, radially outer and radially inner liners 32 and 34. More specifically, outer liner 32 defines an outer boundary of combustion chamber 30, and inner liner 34 defines an inner boundary of combustion chamber 30. Liners 32 and 34 are radially inward from an annular combustor casing 36 which extends circumferentially around liners 32 and 34.

Combustor 16 also includes an annular dome 40 mounted upstream from outer and inner liners 32 and 34, respectively. Dome 40 defines an upstream end of combustion chamber 30 and mixer assemblies 41 are spaced circumferentially around dome 40 to deliver a mixture of fuel and air to combustion chamber 30.

Each mixer assembly 41 includes a pilot mixer 42, a main mixer 44, and a centerbody 43 extending therebetween. Centerbody 43 defines a chamber 50 that is in flow communication with, and downstream from, pilot mixer 42. Chamber 50 has an axis of symmetry 52, and is generally cylindrical-shaped. A pilot fuel nozzle 54 extends into chamber 50 and is mounted symmetrically with respect to axis of symmetry 52. Nozzle 54 includes a fuel injector 58 for dispensing droplets of fuel into pilot chamber 50. In one embodiment, pilot fuel injector 58 supplies fuel through injection jets (not shown). In an alternative embodiment, pilot fuel injector 58 supplies fuel through injection simplex sprays (not shown).

Pilot mixer 42 also includes a pair of concentrically mounted swirlers 60. More specifically, swirlers 60 are axial swirlers and include a pilot inner swirler 62 and a pilot outer swirler 64. Pilot inner swirler 62 is annular and is circumferentially disposed around pilot fuel injector 58. Each swirler 62 and 64 includes a plurality of vanes 66 and 68, respectively, positioned upstream from pilot fuel injector 58. Vanes 66 and 68 are selected to provide desired ignition characteristics, lean stability, and low carbon monoxide (CO) and hydrocarbon (HC) emissions during low engine power operations.

A pilot splitter 70 is radially between pilot inner swirler 62 and pilot outer swirler 64, and extends downstream from pilot inner swirler 62 and pilot outer swirler 64. More specifically, pilot splitter 70 is annular and extends circumferentially around pilot inner swirler 62 to separate airflow traveling through inner swirler 62 from that flowing through outer swirler 64. Splitter 70 has a converging-diverging inner surface 74 which provides a fuel-filming surface during engine low power operations. Splitter 70 also reduces axial velocities of air flowing through pilot mixer 42 to allow recirculation of hot gases.

Pilot outer swirler 64 is radially outward from pilot inner swirler 62, and radially inward from an inner surface 78 of pilot housing 46. More specifically, pilot outer swirler 64 extends circumferentially around pilot inner swirler 62 and is radially between pilot splitter 70 and pilot housing 46. In one embodiment, pilot inner swirler vanes 66 swirl air flowing therethrough in the same direction as air flowing through pilot outer swirler vanes 68. In another embodiment, pilot inner swirler vanes 66 swirl air flowing therethrough in a first direction that is opposite a second direction that pilot outer swirler vanes 68 swirl air flowing therethrough.

Main mixer 44 includes an annular main housing 90 that defines an annular cavity 92. Main mixer 44 is concentrically aligned with respect to pilot mixer 42 and extends circumferentially around pilot mixer 42. A fuel manifold 94 extends between pilot mixer 42 and main mixer 44. More specifically, fuel manifold 94 extends circumferentially around pilot mixer 42 and is between centerbody 43 and main housing 90.

Fuel manifold 94 includes a plurality of injection ports 98 mounted to an exterior surface 100 of housing 96 for injecting fuel radially outwardly from fuel manifold 94 into main mixer cavity 92. Fuel injection ports 98 facilitate circumferential fuel-air mixing within main mixer 44.

In one embodiment, manifold 94 includes a pair of rows of circumferentially-spaced injection ports 98. In another embodiment, manifold 94 includes a plurality of injection ports 98 that are not arranged in circumferentially-spaced rows. A location of injection ports 98 is selected to adjust a degree of fuel-air mixing to achieve low nitrous oxide (NOx) emissions and to insure complete combustion under variable engine operating conditions. Furthermore, the injection port location is also selected to facilitate reducing or preventing combustion instability.

Centerbody 43 separates pilot mixer 42 and main mixer 44. Accordingly, pilot mixer 42 is sheltered from main mixer 44 during pilot operation to facilitate improving pilot performance stability and efficiency, while also reducing CO and HC emissions. Furthermore, centerbody 43 is shaped to facilitate completing a burnout of pilot fuel injected into combustor 16. More specifically, an inner wall 102 of centerbody 93 includes a converging-diverging surface 104, an aft shield 106, and a lip 108 that extends outwardly therebetween and facilitates controlling diffusion and mixing of the pilot flame into airflow exiting main mixer 44.

Converging-diverging surface 104 extends from a leading edge 110 to lip 108, and aft shield 106 extends from lip 108 to a trailing edge 112. Lip 108 includes a substantially planar surface 120, a back approach 122, and a sharp corner 124 extending therebetween. Surface 120 extends from surface 104 to corner 122 and defines a lip width 130 at corner 122. Moreover, corner 124 is offset upstream a distance 134 from aft shield 106. Distance 134 is known as a lip recess or lip immersion. In the exemplary embodiment, distance 134 is approximately equal 5.0 mils.

Lip corner 124 is at surface downstream end 132 and extends between surface 120 and back approach 122. More specifically, lip corner 124 is oriented greater than ninety degrees from approach 122 and slightly less than ninety degrees from surface 120.

Back approach 122 is blown towards lip surface 120 in an arcuate shape that is defined by a radius $R_1$. In the exemplary embodiment, radius $R_1$ is approximately equal 5.0 mils. Alternatively, back approach 122 is not blown towards lip surface 120 and is not defined by radius $R_1$. Back approach radius $R_1$ is smaller than a centerbody radius $R_2$ defining the orientation of aft shield 106 with respect to surface 104. In the exemplary embodiment, centerbody radius $R_2$ is approximately equal to 95 mils.

An orientation of lip 108 is variably selected to facilitate improving ignition characteristics, combustion stability at high and lower power operations, and emissions generated at lower power operating conditions. More specifically, radius $R_1$, lip width 130, offset distance 134, radius $R_2$, an orientation of surface 120 with respect to surface 104, and an orientation of corner 122 with respect to back approach 122 and to surface 120 are variably selected to facilitate improving ignition characteristics, combustion stability at high and lower power operations, and emissions generated at lower power operating conditions.

Main mixer 44 also includes a first swirler 140 and a second swirler 142, each located upstream from fuel injection ports 98. First swirler 140 is a conical swirler and airflow flowing therethrough is discharged at conical swirler angle (not shown). The conical swirler angle is selected to provide airflow discharged from first swirler 140 with a relatively low radial inward momentum, which facilitates improving radial fuel-air mixing of fuel injected radially outward from injection ports 98. In an alternative embodiment, first swirler 140 is split into pairs of swirling vanes (not shown) that may be co-rotational or counter-rotational.

Second swirler 142 is an axial swirler that discharges air in a direction substantially parallel to center mixer axis of symmetry 52 to facilitate enhancing main mixer fuel-air mixing. In one embodiment, main mixer 44 only includes first swirler 140 and does not include second swirler 142.

A fuel delivery system 150 supplies fuel to combustor 16 and includes a pilot fuel circuit 152 and a main fuel circuit 154. Pilot fuel circuit 152 supplies fuel to pilot fuel injector 58 and main fuel circuit 154 supplies fuel to main mixer 44 and includes a plurality of independent fuel stages used to control nitrous oxide emissions generated within combustor 16.

In operation, as gas turbine engine 10 is started and operated at idle operating conditions, fuel and air are supplied to combustor 16. During gas turbine idle operating conditions, combustor 16 uses only pilot mixer 42 for operating. Pilot fuel circuit 152 injects fuel to combustor 16 through pilot fuel injector 58. Simultaneously, airflow enters pilot swirlers 60 and main mixer swirlers 140 and 142. The pilot airflow flows substantially parallel to center mixer axis of symmetry 52 and strikes pilot splitter 70 which directs the pilot airflow in a swirling motion towards fuel exiting pilot fuel injector 58. More specifically, the airflow is directed into the pilot flame zone downstream from pilot mixer 42 by lip 108. The pilot airflow does not collapse a spray pattern (not shown) of pilot fuel injector 58, but instead stabilizes and atomizes the fuel. Airflow discharged through main mixer 44 is channeled into combustion chamber 30.

Furthermore, during operation, lip corner 124 facilitates separating pilot mixer flow from main mixer flow downstream from centerbody aft shield 106. In addition, the arcuate shape of back approach 122 facilitates preventing fuel from depositing along centerbody surface 120 and aft shield 122, and as such, also facilitates reducing deposit formation along surface 120 and aft shield 122. Utilizing only the pilot fuel stage permits combustor 16 to maintain low power operating efficiency and to control and minimize emissions exiting combustor 16. Because the pilot airflow is separated additionally from the main mixer airflow by lip 108, the pilot fuel is completely ignited and burned, resulting in lean stability and low power emissions of carbon monoxide, hydrocarbons, and nitrous oxide.

As gas turbine engine 10 is accelerated from idle operating conditions to increased power operating conditions, additional fuel and air are directed into combustor 16. In addition to the pilot fuel stage, during increased power operating conditions, main mixer 44 is supplied fuel with main fuel circuit 154 and injected radially outward with fuel injection ports 98. Main mixer swirlers 140 and 142 facilitate radial and circumferential fuel-air mixing to provide a substantially uniform fuel and air distribution for combustion. More specifically, airflow exiting main mixer swirlers 140 and 142 forces the fuel to extend radially outward to penetrate main mixer cavity 92 to facilitate fuel-air mixing and to enable main mixer 44 to operate with a lean air-fuel mixture. In addition, uniformly distributing the fuel-air mixture facilitates obtaining a complete combustion to reduce high power operation $NO_x$ emissions.

The above-described combustor is cost-effective and highly reliable. The combustor includes a mixer assembly that includes a pilot mixer, a main mixer, and a centerbody. The pilot mixer is used during lower power operations and the main mixer is used during mid and high power operations. During idle power operating conditions, the combustor operates with low emissions and has only air supplied to the main mixer. During increased power operating conditions, the combustor also supplies fuel to the main mixer which includes a conical swirler to improve main mixer fuel-air mixing. The centerbody lip facilitates uniformly distributing the pilot fuel-air mixture to improve combustion and lower an overall flame temperature within the combustor. The lower operating temperatures and improved combustion facilitate increased operating efficiencies and decreased combustor emissions at high power operations. As a result, the combustor operates with a high combustion efficiency and low carbon monoxide, nitrous oxide, and smoke emissions.

While the invention has been described in terms of various specific embodiments, those skilled in the art will recognize that the invention can be practiced with modification within the spirit and scope of the claims.

What is claimed is:

1. A combustor for a gas turbine comprising:

a pilot mixer comprising an air splitter, a pilot fuel nozzle, and a plurality of axial air swirlers upstream from said pilot fuel nozzle, said air splitter downstream from said pilot fuel nozzle, said air swirlers radially outward from and concentrically mounted with respect to said pilot fuel nozzle;

a main mixer radially outward from and concentrically aligned with respect to said pilot mixer, said main mixer comprising a plurality of fuel injection ports and a swirler comprising at least one of a conical air swirler and a cyclone air swirler, said main mixer swirler upstream from said main mixer fuel injection ports; and an annular centerbody extending between said pilot mixer and main mixer, said centerbody comprising a radially inner surface comprising a divergent portion, an aft portion, and a lip extending outwardly therebetween.

2. A combustor in accordance with claim 1 wherein said centerbody inner surface lip configured to separate flow from said centerbody inner surface.

3. A combustor in accordance with claim 1 wherein said centerbody inner surface lip configured to facilitate reducing deposit formation along said centerbody radially inner surface.

4. A combustor in accordance with claim 1 wherein said centerbody inner surface lip configured to facilitate isolating pilot flows from cyclone flows within said combustor.

5. A combustor in accordance with claim 1 wherein said centerbody inner surface lip comprises an extension, a corner, and a back approach, said corner extending between said extension and said back approach.

6. A combustor in accordance with claim 5 wherein said centerbody surface lip back approach facilitates preventing fuel from filming against said centerbody inner surface aft portion.

7. A combustor in accordance with claim 5 wherein said centerbody surface lip corner facilitates directing pilot flow into a pilot flame zone downstream from said pilot mixer.

8. A mixer assembly for a gas turbine engine combustor, said mixer assembly configured to control emissions from the combustor and comprising a pilot mixer, a main mixer, and an annular centerbody, said pilot mixer comprising a pilot fuel nozzle, and a plurality of axial swirlers upstream and radially outward from said pilot fuel nozzle, said main mixer radially outward from and concentric with respect to said pilot mixer, said main mixer comprising a plurality of fuel injection ports and a swirler upstream from said fuel injection ports, said centerbody extending between said main mixer and said pilot mixer and configured to direct flow exiting said pilot mixer into a pilot flame zone downstream from said pilot mixer.

9. A mixer assembly in accordance with claim 8 wherein said annular centerbody comprises a radially inner surface comprising a divergent portion, an aft portion, and a lip extending outwardly therebetween and configured to facilitate isolating a flow exiting said pilot mixer from a flow exiting said main mixer.

10. A mixer assembly in accordance with claim 9 wherein said centerbody inner surface lip configured to facilitate reducing deposit formation along said centerbody radially inner surface.

11. A mixer assembly in accordance with claim 9 wherein said centerbody inner surface lip comprises an extension, a corner, and a back approach, said corner extend said extension and said back approach.

12. A mixer assembly in accordance with claim 11 wherein said centerbody surface lip back approach facilitates preventing fuel from filming against said centerbody inner surface aft portion.

13. A mixer assembly in accordance with claim 11 wherein said centerbody surface lip back approach comprises a radius.

14. A mixer assembly in accordance with claim 11 wherein said main mixer comprises at least one of a conical main swirler and a cyclone air swirler.

* * * * *

UNITED STATES PATENT AND TRADEMARK OFFICE

CERTIFICATE OF CORRECTION

PATENT NO. : 6,865,889 B2
DATED : March 15, 2005
INVENTOR(S) : Mancini et al.

It is certified that error appears in the above-identified patent and that said Letters Patent is hereby corrected as shown below:

Column 6,
Line 63, delete "an aft portion, and a lip extending outwardly therebetween." and insert therefor -- an aft portion substantially perpendicular to said divergent portion, and a finite thickness lip projecting backwardly and outwardly therebetween. --.

Column 8,
Line 2, delete "pilot mixer." and insert therefor -- pilot mixer; wherein said annular centerbody comprises a radially inner surface comprising a divergent portion, an aft portion substantially perpendicular to said divergent portion, and a finite thickness lip projecting backwardly and outwardly therebetween. --.
Line 4, delete "comprises a radially inner surface comprising a divergent portion, an aft portion, and a lip extending outwardly therebetween and configured" and insert therefor -- is configured --.
Line 15, delete "said corner extend said" and insert therefor -- said corner extending between said --.

Signed and Sealed this

Thirtieth Day of August, 2005

JON W. DUDAS
*Director of the United States Patent and Trademark Office*